US005944357A

United States Patent [19]

Instance

[11] Patent Number: 5,944,357

[45] Date of Patent: Aug. 31, 1999

[54] LABELS AND MANUFACTURE THEREOF

[76] Inventor: David John Instance, Guinea Hall, Sellindge, Kent TN24 6EG, United Kingdom

[21] Appl. No.: 08/983,046

[22] PCT Filed: Feb. 15, 1996

[86] PCT No.: PCT/GB96/00345

§ 371 Date: Jan. 29, 1998

§ 102(e) Date: Jan. 29, 1998

[87] PCT Pub. No.: WO97/04433

PCT Pub. Date: Feb. 6, 1997

[30] Foreign Application Priority Data

Jul. 19, 1995 [GB] United Kingdom ..... 9514736

[51] Int. Cl.[6] ..... B42D 15/00

[52] U.S. Cl. ..... 283/101; 283/81; 283/36; 281/2; 281/5; 428/40.1; 156/250

[58] Field of Search ..... 283/81, 100, 101, 283/107, 36; 428/40.1, 42.1, 42.2, 42.3, 43, 41.8, 124, 126, 130, 192, 194, 195; 281/2, 5; 156/253, 267, 268, 269, 270, 290, 291, 299, 300, 301, 303, 250

[56] References Cited

U.S. PATENT DOCUMENTS 2,246,984 6/1941 Palmer .

4,285,999 8/1981 Olivieri et al. ..... 428/42.1

4,744,591 5/1988 Instance ..... 281/5

4,991,878 2/1991 Cowan et al. ..... 283/81

5,399,403 3/1995 Instance ..... 428/41.8

FOREIGN PATENT DOCUMENTS 2247662 3/1992 United Kingdom .

*Primary Examiner*—Frances Han

*Attorney, Agent, or Firm*—Rothwell, Figg, Ernst & Kurz, P.C.

[57] ABSTRACT

A self-adhesive label (26) carried on a backing of release material (20) comprising a multilaminar label portion (32), a tab portion (40) comprising a sheet which is spaced from the multilaminar label portion (32) and a self-adhesive laminar material (42) overlying and adhered by the self-adhesive surface thereof to the upper surface of the multilaminar label portion (32) and the tab portion (40), a region (48) of the laminar material (42) being disposed between the multilaminar label portion (32) and the tab portion (40) and adhered directly to the backing of release material (20). There is also disclosed a method of making a succession of such labels.

16 Claims, 4 Drawing Sheets

LABELS AND MANUFACTURE THEREOF

The present invention relates to a self-adhesive label and to a method of producing a self-adhesive label carried on a backing of release material.

A number of self-adhesive multilaminar leaflet or booklet labels are known, together with methods for their manufacture. For example, GB-A-2247662 discloses a multilaminar label in which a leaflet or booklet is adhered to a self-adhesive support piece and the entire assembly is covered with a self-adhesive plastics overlaminate.

The present invention aims to provide an improved self-adhesive label and method of producing such labels.

Accordingly the present invention provides a self-adhesive label carried on a backing of release material comprising a multilaminar label portion, a tab portion comprising a sheet which is spaced from the multilaminar label portion and a self-adhesive laminar material overlying and adhered by the self-adhesive surface thereof to the upper surface of the multilaminar label portion and the tab portion, a region of the laminar material being disposed between the multilaminar label portion and the tab portion and adhered directly to the backing of release material.

The present invention further provides a method of producing a succession of self-adhesive labels carried on a length of release backing material, the method comprising the steps of: (a) providing a plurality of multilaminar labels, each having a front panel and a rear part, the front panel including an edge portion extending beyond the rear part and which is provided with at least one cutout therein; (b) disposing the multilaminar labels in succession over a web of release backing material whereby each cutout overlies and exposes a respective portion of the release backing material; (c) adhering a web of self-adhesive laminar material over the succession of multilaminar labels whereby each front panel and each cutout is at least partially covered by the laminar material so that in each cutout the laminar material is adhered directly to the backing of release material; and (d) die-cutting through the laminar material and the multilaminar labels as far as the release backing material thereby to form a plurality of self-adhesive labels, each self-adhesive label comprising a multilaminar label portion, a tab portion spaced from the multilaminar label portion and having being formed from the front panel thereof and a portion of the laminar material adhered to the upper surface of the multilaminar label portion and of the tab portion, the laminar material having a region thereof which is adhered directly to the backing of release material between the multilaminar label portion and the tab portion.

Embodiments of the present invention will now be described by way of example only, with reference to the accompanying drawings, in which.

Figure 1:
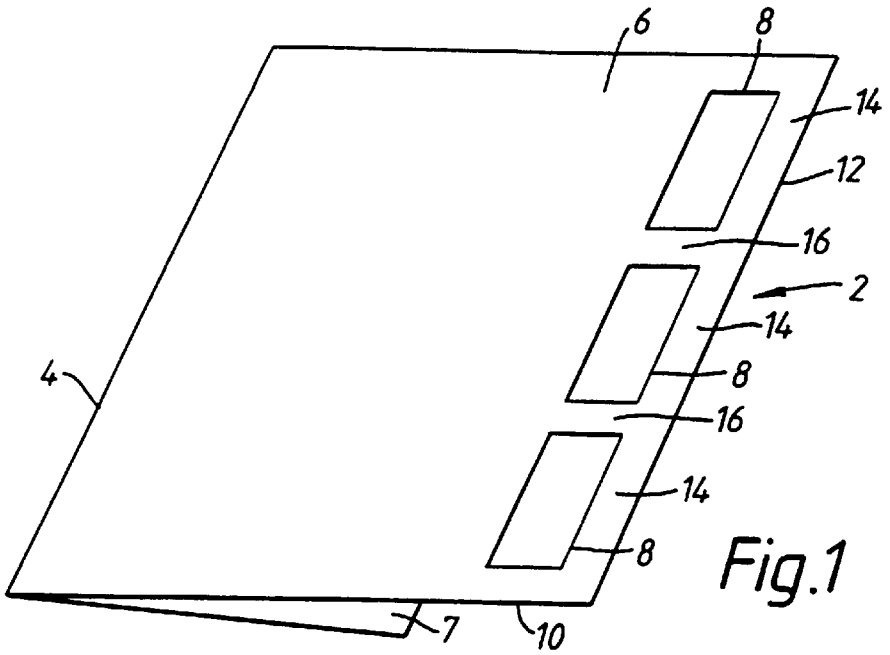
FIG. 1 is a perspective view of a folded leaflet for use in manufacturing self-adhesive labels in accordance with a first embodiment of the present invention.

Referring to FIG. 1, there is shown a printed multilaminar label designated generally as 2 which comprises a paper leaflet, preferably rectangular, which has been folded along a fold line 4 to form a front panel 6 and a rear panel 8. It is to be understood that although the present invention is described herein with reference to a folded sheet in the form of a leaflet having a single fold line as illustrated in FIG. 1, the present invention is not limited to such a construction. The folded leaflet 2 may alternatively comprise a number of folded panels folded behind the front panel 6 or alternatively the multilaminar label may comprise a multipage booklet having a spine along the folded edge 4. The front panel 6 of the leaflet 2 is provided with a series of cutouts 8 extending transversely across the width of the front panel 6 generally parallel to the fold line 4. Each cutout 8 has been formed by cutting, e.g. by die-cutting, punching, laser cutting, etc. through the front panel 6. Each cutout 8 corresponds with a respective printed area (not shown) on the folded leaflet 2 and each cutout 8 is intended to be incorporated in a respective resultant self-adhesive label. In the illustrated embodiment, three cutouts 8 are provided in each folded leaflet 2, with there being three corresponding printed areas on the leaflet 2, whereby each leaflet 2 is intended to form three identical self-adhesive labels. However, any suitable number may be provided. Although in the illustrated embodiment the cutouts 8 are shown as rectangular, they may be any other suitable shape.

The cutouts 8 are formed in an extending part 10 of the front panel 6 which is not covered on its reverse side by any further panel or panels, such as rear panel 8. The cutouts 8 are spaced inwardly of the free outer edge 12 of the front panel 6 so as to provide corresponding edge portions 14 of the front panel 6 spaced transversely across the front panel 6. The cutouts 8 are separated transversely by connecting portions 16 which are provided in order to impart sufficient strength and rigidity to the folded leaflet 2 during the manufacturing process. The extending portions 16 are not present in the resultant self-adhesive labels.

Figure 2:
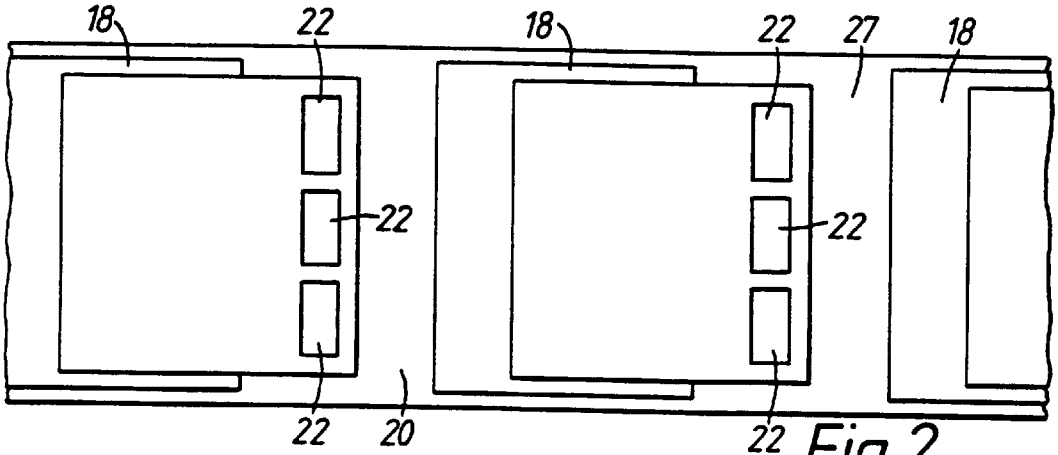
FIG. 2 is a plan view of an assembly of the leaflets of FIG. 1 when disposed in succession on respective self-adhesive support pieces carried on a backing of release material.

Referring to FIG. 2, the folded leaflets 2 are applied in succession to a respective succession of self-adhesive support pieces 18 which are adhered along a length of release backing material 20. Each support piece 18 is coated on its rear face with a layer of pressure-sensitive adhesive which is adhered to the release backing material 20 which typically comprises a silicone-coated paper web. The folded leaflets 2 are applied so that the folded edge 4 and at least part of the rear panel 8 overlie the self-adhesive support piece 18 and so that the cutouts 8 overlie and expose respective portions 22 of the release backing material 20.

Figure 3:
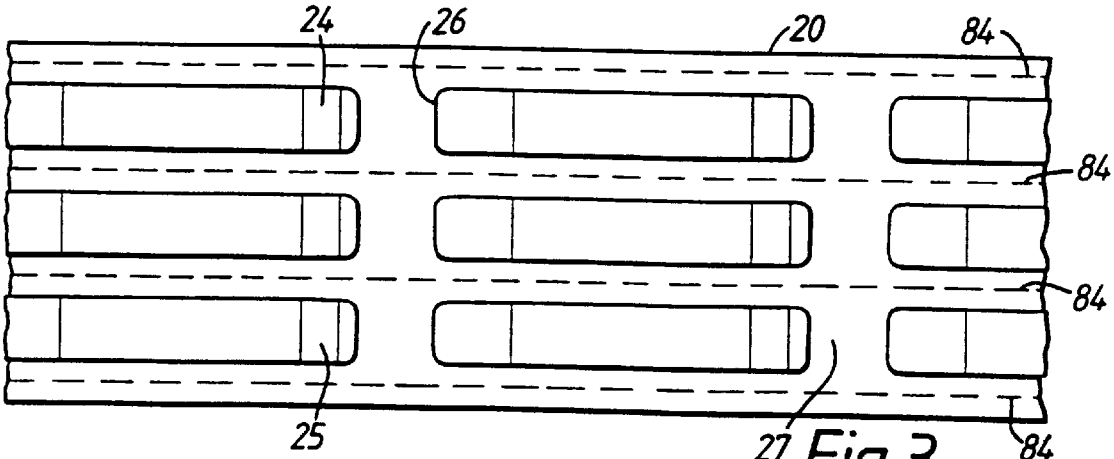
FIG. 3 shows the assembly of FIG. 2 following an overlaminating step with a transparent self-adhesive laminar material and a subsequent die-cutting step to produce a plurality of self-adhesive labels in accordance with the first embodiment of the present invention.

Referring to FIG. 3, there is shown the assembly shown in FIG. 2 following an overlaminating step and a subsequent die cutting step. In the overlaminating step, a laminar web of transparent self-adhesive plastics material is laminated over the entire assembly shown in FIG. 2 so that the laminar material 24 covers the succession of assemblies of the folded leaflets 2 on the respective support pieces 18 with the rear self-adhesive surface of the laminar material 24 covering the upper surface of the front panel 6 and the exposed upper surface of the support piece 18 which is not covered by the folded leaflet 2. Regions 25 of the laminar material 24 are also adhered to the release material 20 at those portions 22 thereof which are exposed by the cutouts 8. The laminar material 24 is also adhered to the exposed portions 27 of the release backing material 20 which are between the respective leaflet/support piece assemblies.

In the subsequent die-cutting step, the resultant self-adhesive labels 26 are formed by cutting through the laminar material 24, the folded leaflets 2 and the support pieces 18 down as far as but not through the release backing material 20. The cutting is performed so as to produce a succession of self-adhesive labels 26 along the length of release backing material 20, with there being a plurality, in the illustrated embodiment three self-adhesive labels 26 spaced transversely across the web of release backing material 20. The waste web remnant around the self-adhesive labels is removed. The waste web remnant comprises waste portions of the laminar material 24, the folded leaflets 2 and the support pieces 18.

Figure 4:
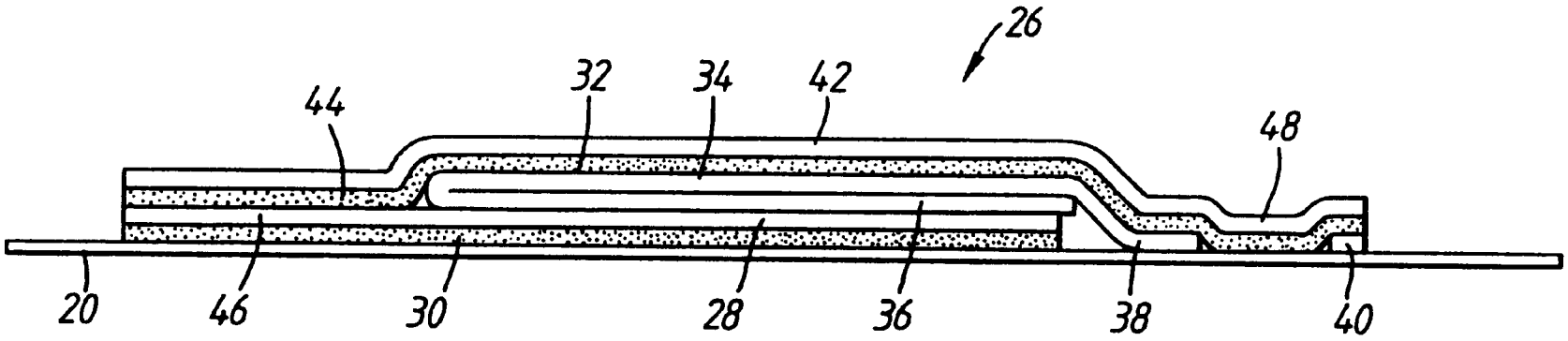
FIG. 4 is a side view of a self-adhesive label carried on a backing of release material in accordance with the first embodiment of the present invention.

The label construction is shown in greater detail with reference to FIG. 4.

Each resultant self-adhesive label 26 comprises an underlying support piece part 28 which is adhered to the web of release backing material 20 by the layer of pressure-sensitive adhesive 30 on the rear surface thereof. The folded leaflet portion 32 comprises a front panel part 34 covering a rear panel part 36. A free transverse edge portion 38 of the front panel part 34 is disposed over the release backing material 20 longitudinally adjacent to the support piece part 28. A tab portion 40 overlying the release backing material 20 is spaced longitudinally from the edge portion 38, the tab portion 40 having being die-cut from a respective edge portion 14 of the folded leaflet 2. A laminar material portion 42 is adhered by its underlying layer of pressure-sensitive adhesive 44 to the upper surfaces of the front panel part 34, of the tab portion 40 and of the exposed edge region 46 of the support piece part 28. In the region of the cutout 8, the laminar material portion 42 has a region 48 thereof which is adhered directly to the release backing material 20. The region 48 of the self-adhesive laminar material part 42 ensures that the folded leaflet portion is held in its folded configuration by the adhesion of the laminar material region 48 to the release backing material 20.

In use, the self-adhesive label 26 is adhered to the surface of a product to the labelled, typically a curved container. When it is desired to open the label, a user manually grabs the tab portion 40 which is not adhered to the container surface directly and the tab portion 40 is pulled away from the container thereby to pull the laminar material region 48 away from adhesive contact with the surface of the container so that the folded leaflet portion may be opened and read by a user. After use, the label may be returned to its closed configuration by adhering the laminar material region 48 again by its self-adhesive surface to the container.

The self-adhesive label 26 of the invention has particular application in the labelling of curved containers, particularly those having a relatively small radius whereby the label 26 can wrap around the entire circumference of a cylindrical container. In FIG. 4, the thickness of the various layers of the label are obviously exaggerated for clarity of illustration. However, it will be understood that when the label 26 is wrapped around a relatively small radius, the outer layer of the label 26, in particular the laminar material portion 42, is required to be wrapped around a larger radius than the inner layer, for example the support piece part 28. This difference in radii is accommodated readily by the label of the present invention because the laminar material region 48 which retains the label 26 in its closed configuration is able to move longitudinally relative to the support piece part 28, i.e. towards or away from the support piece part, thereby to ensure that the label is retained securely in its folded configuration on the cylindrical container.

In the embodiment of FIGS. 1 to 4, the folded leaflet is held in position on the support piece by the adhesion of the laminar material to the support piece and no additional layer of adhesive is provided between the rear panel 8 and the upper surface of the support piece 18.

Figure 5:
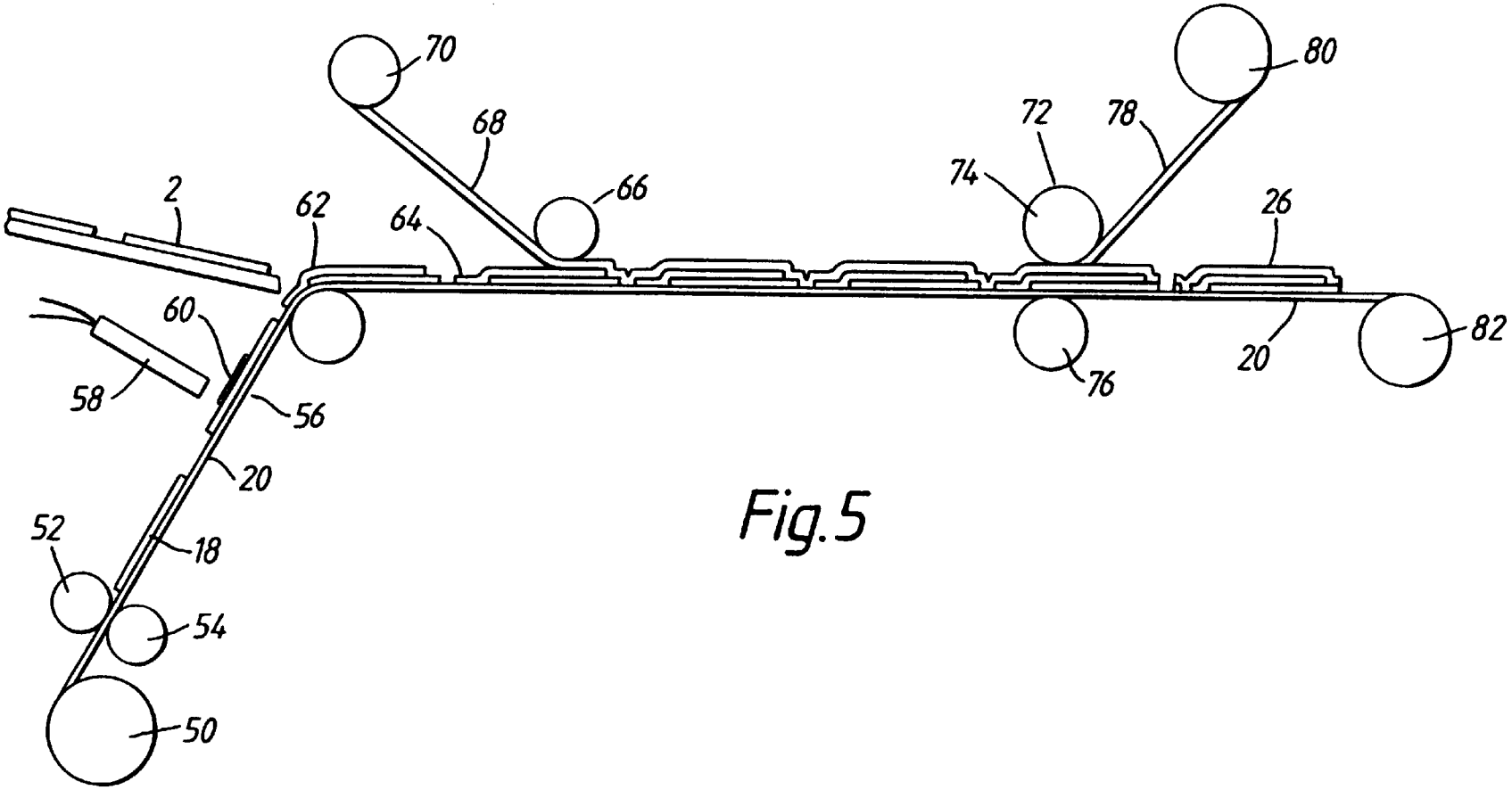
FIG. 5 is a schematic side view of an apparatus for producing labels in accordance with a second embodiment of the present invention.

FIG. 5 illustrates an apparatus for producing labels in accordance with another embodiment of the present invention in which a layer of adhesive is provided between the folded leaflet and the support piece. Referring to FIG. 5, a reel 50 of a web of release backing material 20 carrying a succession of self-adhesive support pieces 18 along its length is fed out between a pair of opposed rollers 52,54 towards an adhesive applying station 56 at which an adhesive applicator 58 applies a layer of adhesive 60 to the upper surface of each support piece 18. The adhesive 60 preferably comprises a water-soluble adhesive or a hot melt adhesive. The web then passes to a leaflet applying station 62 at which folded leaflets 2 are applied in succession to respective layers of adhesive 60 on respective support pieces 18. The resultant assembly has the configuration similar to that shown in FIG. 2. It will be seen from FIG. 5 that the trailing edge 64 of each folded leaflet 2 after it has been applied to the release backing material 20 overlies the release backing material 20. That trailing edge 64 is provided with the cutouts 8 (not shown). The rear surface of the folded leaflet 2 which overlies the support piece 18 is adhered thereto by the layer of adhesive 60.

The combined leaflet/support piece assemblies carried on the release backing material 20 are then conveyed to an overlaminating station 66 at which a web of transparent plastics self-adhesive laminar material 68, supplied from a reel 70, is adhered by its self-adhesive surface over the succession of those assemblies. At a downstream die-cutting station 72, comprising an upper die-cutting roller 74 and a lower backing roller 76 through which the composite web is passed, the succession of self-adhesive labels 26 carried on the release backing material 20 are cut from the leaflet/support assemblies on the web as shown in FIG. 3. The waste web remnant 78 is removed from the release backing material 20 and wound into a reel 80. The self-adhesive labels 26 carried on the release backing material 20 are then wound into a reel 82.

The self-adhesive labels in reel form are intended to be applied automatically to products to be labelled. It is conventional to provide only a single label across the width of the release backing material. Accordingly, with reference to FIG. 3, the release backing material may be slit longitudinally so as to provide a plurality of separate reels, each carrying a respective succession of labels along its length. The intended longitudinal slitting lines are shown by dashed lines 84 in FIG. 3.

Figure 6:
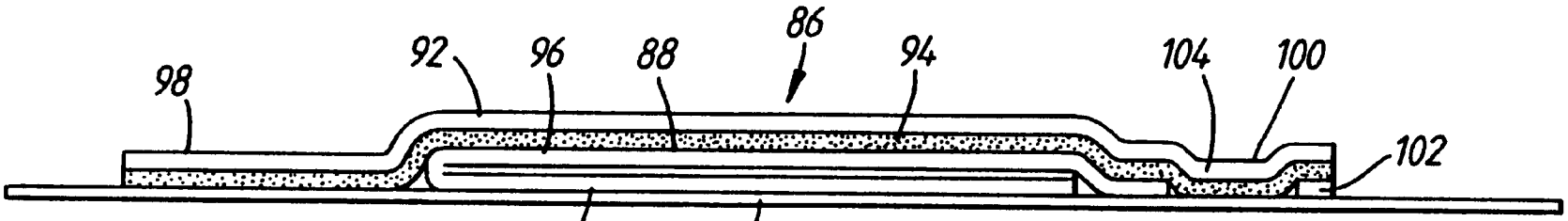
FIG. 6 is a side view of a self-adhesive label carried on a backing of release material in accordance with a third embodiment of the present invention.

Referring now to FIG. 6, there is shown a modification of the self-adhesive label of FIG. 4 in which the label does not incorporate a self-adhesive support piece. The self-adhesive label 86 comprises a booklet 88 which overlies the release backing material 90. A self-adhesive laminar material 92 is adhered by its layer 94 of pressure-sensitive adhesive over the front cover 96 of the booklet 88 and at one transverse edge 92 of the label 86 directly to the release backing material 90. At the other transverse edge 100 of the self-adhesive label 86 there is provided a tab portion 102 which is not adhered directly to the release backing material 90. Located longitudinally inwardly from the tab portion 102 there is provided a region 104 of the self-adhesive laminar material 92 which is adhered directly to the release backing material 90 so as to retain the booklet 88 in its closed configuration. If desired, a layer of adhesive (not shown), preferably a pressure-sensitive adhesive, may be provided between the release backing material 90 and the rear surface of the rearmost sheet 106 of the booklet 88. The booklet may be provided with any desired number of pages and may be any desired shape.

Figure 7:
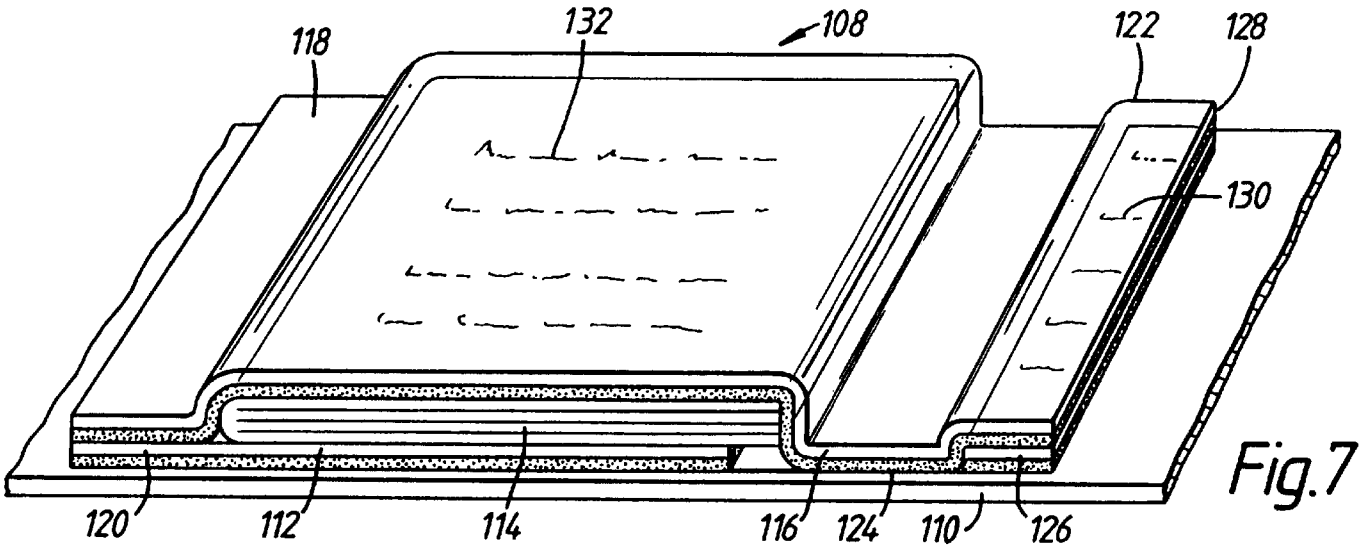
FIG. 7 is a perspective view of a self-adhesive label carried on a backing of release material in accordance with a fourth embodiment of the present invention.
Figure 8:
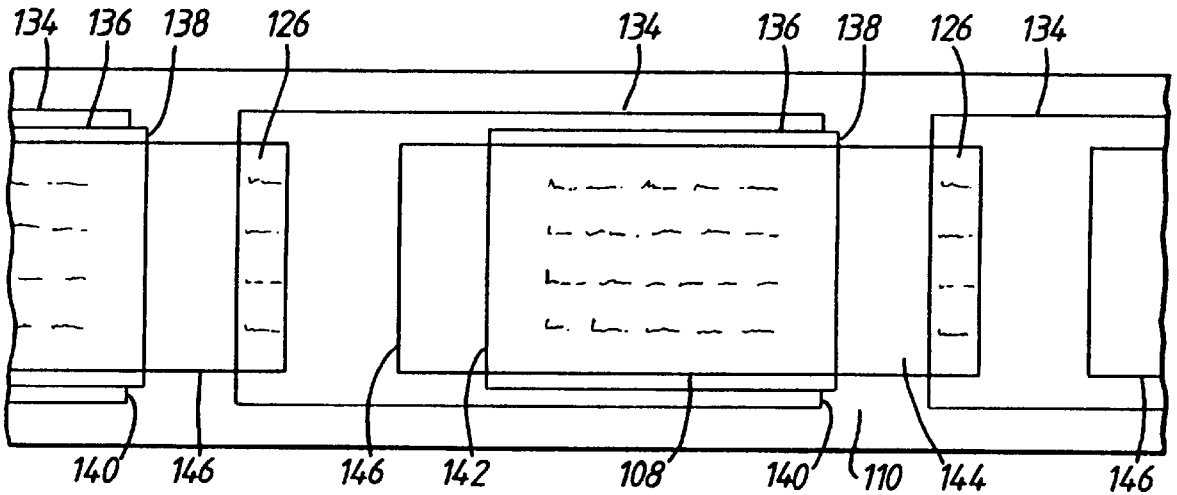
FIG. 8 is a plan view of an assembly of multilaminar labels carried on support pieces following overlaminating and die cutting and illustrates the manufacture of the self-adhesive labels of FIG. 7.

FIGS. 7 and 8 illustrate a further embodiment of a self-adhesive label in accordance with the present invention, together with its method of manufacture.

Referring to FIG. 7, there is shown a self-adhesive label 108 carried on a backing web 110 of release material. The self-adhesive label 108 comprises an underlying self-adhesive support piece 112 over which is disposed a booklet 114 and the support piece 112 and the booklet 114 are overlaminated with a self-adhesive transparent plastics laminar material 116. The booklet 114 is positioned on the support piece 112 so that at one transverse edge 118 of the label 108 the self-adhesive laminar material 116 is adhered to an exposed transverse edge 120 of the support piece 112. At the other transverse edge 122 of the label 108 the laminar material 116 is in turn adhered directly to a region 124 of the release material 110 adjacent to the booklet 114 and then at the extreme edge over an elongate transversely directed self-adhesive tab portion 126 which extends along the transverse width of the label edge 128. The self-adhesive tab portion 126 is formed from the same pressure-sensitive material as the support piece 112. The upper surface of the tab portion 126 may be printed with any desired image 130 along its length, and as described hereinbefore, the booklet may also be printed with images, such as the image 132 on the front cover of the booklet 114.

The method of manufacturing the label of FIG. 7 is illustrated in FIG. 8. A succession of self-support pieces 134 is provided along the length of a web of release backing material 110 in the manner similar to that illustrated in FIG. 2. A succession of booklets 136 is then disposed over the succession of support pieces 134 so that each booklet 136 partially covers a respective support piece 134. In the illustrated embodiment, the open edge 138 of each booklet 136 extends past a corresponding adjacent transverse edge 140 of the respective support piece. This is provided so that when the label is wrapped around a curved container, the laminar material does not inadvertently adhere to the support piece. The folded edge 142 of each booklet 136 lies over the respective support piece 134. The entire web assembly is overlaminated with a transparent plastics self-adhesive laminar material 144 in the manner similar to that described hereinbefore with referent to FIG. 3 and the entire assembly is then die-cut to form the self-adhesive labels 108. FIG. 8 shows the shape and position of the die-cut line 146 which defines the self-adhesive labels 108. The remaining portions of the support pieces 134, the booklets 136 and the laminar material 144 are removed as a waste web remnant. It will be seen from FIG. 8 that for each label 108, the tab portion 126 is formed from the support piece 134 of an adjacent label 108. In the region between the tab portion 126 and the booklet portion 136 for each label 108, the laminar material 144 is adhered directly to the release material 110. The tab portion 126 may readily be printed with information as described hereinabove.

The labels of the present invention have a number of advantageous benefits. The provision of a tab portion which extends along the whole transverse edge of the label provides a label which is very easy to use in that a large area of tab portion is provided to enable a user to pull the tab portion away from the container which is labelled in order to be able to open the label. When the label is wrapped around a small radius container, with a relatively tight wrap, an elongate tab portion in the form of a sheet is easy for a user to get hold of in order to open the label. The provision of a sheet to form the tab portion provides increased stiffness at the transverse edge of the label which not only assists a user in opening the label but also facilitates high speed dispensing of the labels from the backing of release material so as to be adhered onto the containers to be labelled by automatic labelling machinery. Furthermore, the provision of an elongate tab portion along the transverse edge of the label enables the whole transverse edge to carry printed information along its length, thereby providing increased labelling surface area and on which may be provided information on how to open the label. This is a real technical and commercial benefit. In the embodiment of FIGS. 7 and 8, the self-adhesive support piece can readily be printed so as to enable the tab portion upper surface to carry the appropriate information. In addition, in the embodiments of FIGS. 1 to 6 the tab portion is provided with an unadhesive rear face so that when the label is adhered to the container the tab portion is not directly adhered to the container thereby readily permitting a user to be able to pull the tab portion away from the container in order to open the label.

I claim:

1. A self-adhesive label carried on a backing of release material comprising a multilaminar label portion, a tab portion comprising a sheet which is spaced from the multilaminar label portion and a self-adhesive laminar material overlying and adhered by the self-adhesive surface thereof to the upper surface of the multilaminar label portion and the tab portion, a region of the laminar material being disposed between the multilaminar label portion and the tab portion and adhered directly to the backing of release material.

2. A self-adhesive label according to claim 1 wherein the tab portion and the multilaminar label portion are formed from the same sheet material.

3. A self-adhesive label according to claim 1 wherein the tab portion has a rear surface thereof which is unadhered to the release material.

4. A self-adhesive label according to claim 1 comprising a self-adhesive support piece which carries the multilaminar label portion and has a self-adhesive rear surface which is adhered to the release material.

5. A self-adhesive label according to claim 4 further comprising a layer of adhesive between the support piece and the multilaminar label portion.

6. A self-adhesive label according to claim 4 wherein the self-adhesive laminar material overlies and is adhered to the upper surface of a portion of the support piece which is not covered by the multilaminar label portion.

7. A self-adhesive label according to claim 1 wherein the multilaminar label portion is a folded leaflet.

8. A self-adhesive label according to claim 1 wherein the multilaminar label portion is a booklet.

9. A method of producing a succession of self-adhesive labels carried on a length of release backing material, the method comprising the steps of:

(a) providing a plurality of multilaminar labels, each having a front panel and a rear part, the front panel including an edge portion extending beyond the rear part and which is provided with at least one cutout therein;

(b) disposing the multilaminar labels in succession over a web of release backing material whereby each cutout overlies and exposes a respective portion of the release backing material;

(c) adhering a web of self-adhesive laminar material over the succession of multilaminar labels whereby each front panel and each cutout is at least partially covered by the laminar material so that in each cutout the laminar material is adhered directly to the backing of release material; and (d) die-cutting through the laminar material and the multilaminar labels as far as the release backing material thereby to form a plurality of self-adhesive labels, each self-adhesive label comprising a multilaminar label portion, a tab portion spaced from the multilaminar label portion and having being formed from the front panel thereof and a portion of the laminar material adhered to the upper surface of the multilaminar label portion and of the tab portion, the laminar material having a region thereof which is adhered directly to the backing of release material between the multilaminar label portion and the tab portion.

10. A method according to claim 9 wherein the tab portion has a rear surface thereof which is unadhered to the release material.

11. A method according to claim 9 wherein in step (b) the multilaminar labels are disposed in succession over respective self-adhesive support pieces which are adhered to the release material and in step (d) the self-adhesive support pieces are additionally die-cut so that each self-adhesive label includes a support piece portion.

12. A method according to claim 11 wherein each multilaminar label is adhered to the respective support piece by a layer of adhesive therebetween.

13. A method according to claim 11 wherein the multilaminar label is disposed on the respective support piece so as partially to expose the respective support piece whereby in each resultant label, a portion of the support piece which is not covered by the multilaminar label portion is provided adjacent the multilaminar label portion and is covered by the self-adhesive laminar material.

14. A method according to claim 9 wherein each multilaminar label is die-cut into a plurality of multi-laminar label portions and is provided with a corresponding plurality of cutouts therein whereby a corresponding plurality of self-adhesive labels is provided transversely across the web following the die-cutting step.

15. A method according to claim 9 wherein each multilaminar label comprises a folded leaflet.

16. A method according to claim 9 wherein each multilaminar label comprises a booklet.

* * * * *